US005673657A

United States Patent [19]

Cecur

[11] Patent Number: 5,673,657

[45] Date of Patent: Oct. 7, 1997

[54] DIRECT-ACTING HYDRAULIC TAPPET WITH ROLLER FOLLOWER

[75] Inventor: Majo Cecur, Rivarolo Canavese, Italy

[73] Assignee: Eaton Corporation, Cleveland, Ohio

[21] Appl. No.: 729,212

[22] Filed: Oct. 15, 1996

[30] Foreign Application Priority Data

Oct. 27, 1995 [IT] Italy ..... MI95A2220

[51] Int. Cl.[6] ..... F01L 1/25

[52] U.S. Cl. ..... 123/90.5; 123/90.55; 74/569

[58] Field of Search ..... 123/90.48, 90.49, 123/90.5, 90.52, 90.55, 90.33, 90.35; 74/569

[56] References Cited

U.S. PATENT DOCUMENTS

| | | | |
|---|---|---|---|
| 4,279,226 | 7/1981 | Lampredi et al. | 123/90.55 |
| 4,361,120 | 11/1982 | Kueny | 123/90.55 |
| 4,633,827 | 1/1987 | Buente | 123/90.55 |
| 5,327,860 | 7/1994 | Krüger | 123/90.55 |
| 5,415,533 | 5/1995 | Egger et al. | 123/90.5 |
| 5,566,652 | 10/1996 | Deppe | 123/90.5 |

*Primary Examiner*—Weilun Lo

*Attorney, Agent, or Firm*—L. J. Kasper

[57] ABSTRACT

A direct-acting hydraulic tappet which includes a roller cam follower which is received in a plastic block mounted in a piston slidingly received within the tappet body. The plastic block includes upwardly extending fins which straddle the engine cam to maintain alignment of the roller with respect to the cam. The plastic block is formed to define an annular low pressure reservoir between it and a lower portion of the piston, and ports are formed in the bottom of the piston to permit oil flow between the annular reservoir and a high pressure chamber defined between the bottom of the piston and the bottom of the body. A check valve in the form of a flat disk is fixed to the piston in position to close the ports when the high pressure chamber is pressurized.

7 Claims, 2 Drawing Sheets

DIRECT-ACTING HYDRAULIC TAPPET WITH ROLLER FOLLOWER

The present invention relates to a direct-acting hydraulic tappet provided with a roller for contacting the cam of the camshaft of an internal combustion engine.

Direct-acting (bucket) hydraulic tappets usually consist of a body having a substantially flat top surface which is actuated by one of the cams of the camshaft of an engine. The downwardly directed thrust applied to the head of the bucket-type tappet is transferred from the tappet itself to a valve stem which is in turn biased upwardly by a spring.

According to the prior art, as the camshaft turns the contact between the cam lobe and the tappet surface is of a sliding type and the consequent friction wears said surface so that it is necessary to specifically choose the material of the flat plate forming the tappet cam contacting surface and to grind the surface to a high degree of accuracy. The sliding friction also causes an energy loss within the engine which reduces the efficiency of the engine.

Accordingly, it is the main object of the present invention to reduce the wear of the cam contacting surface and the mentioned energy loss thereby increasing the life of the tappet and of the cams, as well as increasing the engine efficiency.

It is another object of the present invention to provide a direct-acting hydraulic tappet of simplified construction, preserving the advantage of the use of such tappets in compensating for lash in the engine valve train, but with less demanding machining tolerances.

A further object of the present invention is that of not increasing the height of the tappet.

According to the present invention, the sliding friction on the surface of the tappet head is replaced by a rolling friction by providing the head of the tappet with a simple cam contacting roller, made of hardened steel, the axis of the roller being parallel to the rotation axis of the camshaft.

This roller is housed and held in a plastic block surrounding the roller more than half of its circumference, in order to retain the roller in its seat while allowing it to rotate.

The plastic block is fitted within a piston, consisting of a cup-shaped element, opened at the top, which is in turn fitted and vertically sliding in a tappet body consisting of a hollow cylindrical element opened at the top and having a closed bottom base. Thus, two reservoirs are defined for containing the oil for the operation of the hydraulic tappet, more specifically a low pressure reservoir formed by an annular cavity defined between the plastic block and the inner piston, and a high pressure chamber formed by the cavity between the piston and the tappet body.

In order to adjust the lash that can occur between the valve and the tappet, a spring is provided for raising the hydraulic element so as to cause a pressure drop in the high pressure chamber.

Oil coming from the lubricating circuit of the engine, after having provided lubrication between the roller and the camshaft, will fill by gravity the open well formed on the top of the plastic block in the surroundings of the wall of the piston and passes down, along two slots on the sides of the block, into the low pressure reservoir, also filling the high pressure chamber through flow ports located at the base of the piston and provided with a check valve which opens when the pressure in the high pressure chamber decreases as the roller contacts the base circle of the cam.

The base of the plastic block bears against the inner bottom of the piston and, together with the latter, is held resiliently pressed upwards by a helical spring housed in the body of the tappet.

When operating, the transfer of the oil from the low pressure reservoir to the high pressure chamber occurs through a plurality of holes at the bottom of the piston and through the check valve, which opens when the piston is again pushed upwards by the spring housed in the tappet body.

For a proper operation of the hydraulic tappet, a controlled leakage of the oil past a leakdown surface is necessary. Since the diameter of the leakdown surface is about three times larger than that of a conventional direct-acting hydraulic tappet, the relative fit of the parts is less sensitive to machining tolerances, and this permits the use of machining operations with greater tolerances and accordingly with lower manufacturing costs.

In comparison with the hydraulic tappets of the several types which are presently used, the tappet according to the present invention also has the advantage of being composed of a lower number of component parts which can further be manufactured by comparatively simple and economical operations with no stringent tolerance requirements, particularly with respect to the relationship between the piston wall and the tappet body wall.

The present invention will be disclosed hereinafter, in a more detailed manner, by means of a preferred embodiment thereof, with reference to the accompanying drawings, wherein.

Figure 1:
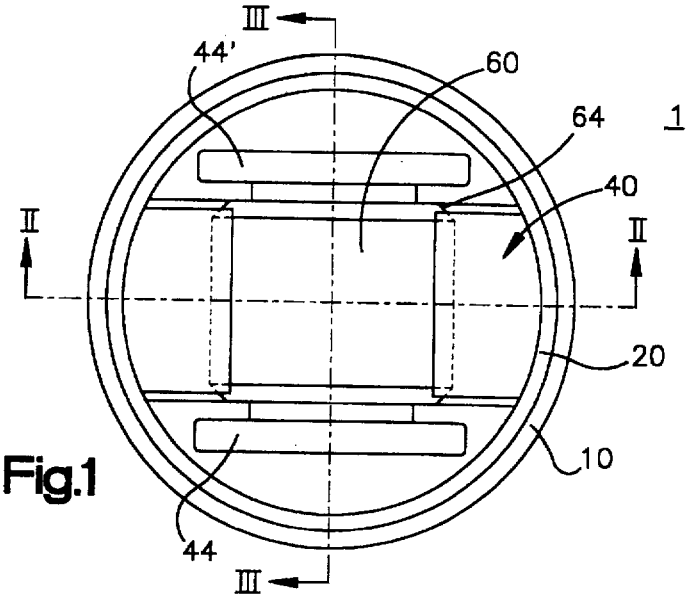
FIG. 1 is a top plan view of a hydraulic tappet according to the present invention.
Figure 2:
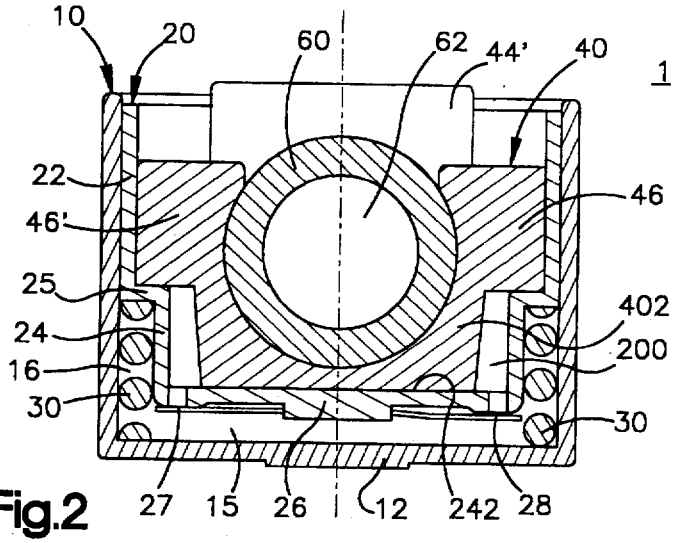
FIG. 2 is a cross-section view of the subject hydraulic tappet substantially taken along the section line II—II of FIG. 1.
Figure 3:
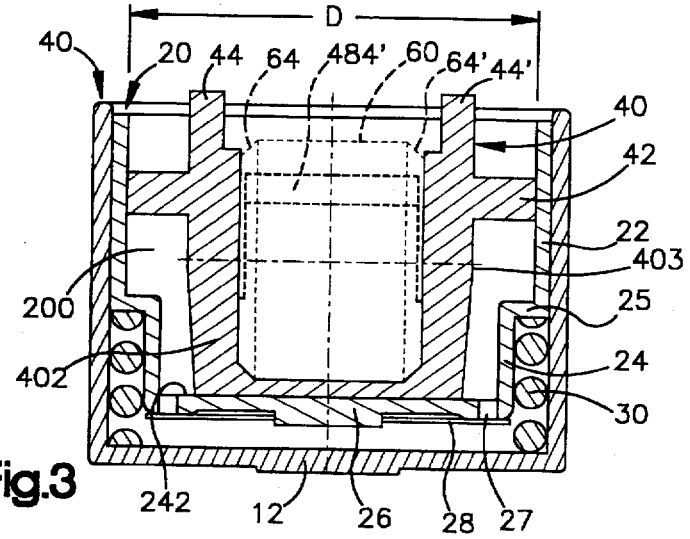
FIG. 3 is a further cross-section view of the subject hydraulic tappet taken along line III—III of FIG. 1.

As shown in FIGS. 1 to 3, the hydraulic tappet, generally indicated by the reference number 1, comprises an outer body 10 formed by a hollow cylindrical element opened at the top, and closed at the bottom by a base 12, which engages an engine valve (not shown). A small piston 20 is inserted in the body 10 and comprises a cup-shaped element, the top portion 22 thereof having an outer diameter in sliding relation to the inner wall of the body 10 so as to be able to slide within said body with a small clearance; whereas, the bottom portion 24 has a smaller diameter to provide an annular recess or undercut 25. Below the annular undercut 25, the bottom portion 24 of the piston 20 forms, with the body 10, a peripheral gap 16 in which a coil spring 30 is housed, the bottom end portion of the coil spring bearing on the bottom of the body 10, whereas the top end portion of the spring bears on the shoulder formed by the annular undercut 25 in order to bias the piston 20 upwardly.

Figure 4:
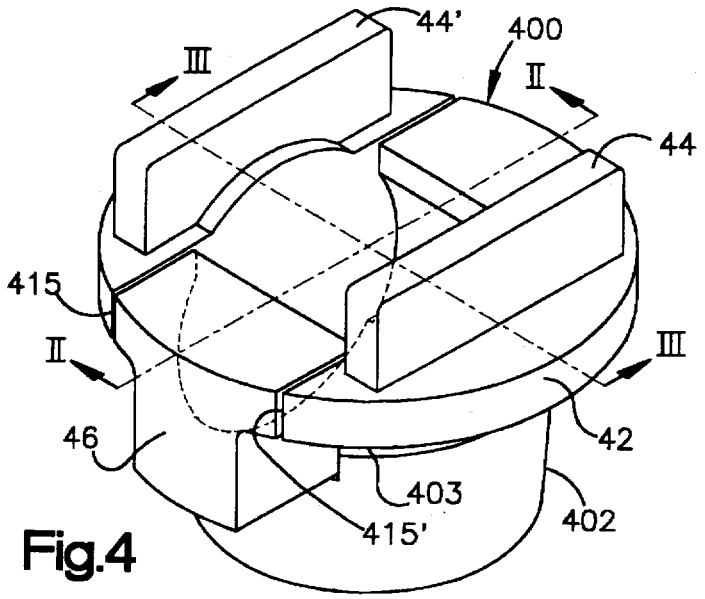
FIG. 4 is an axonometric view illustrating the plastic block forming the seat of the cam contacting roller, included in the tappet according to the invention.
Figure 5:
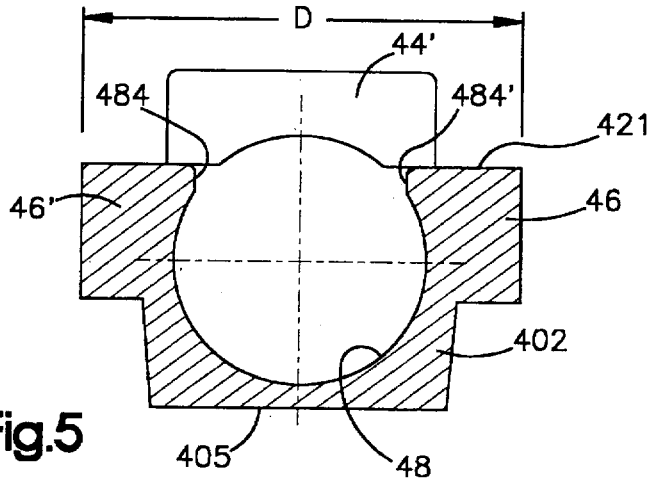
FIG. 5 is a cross-section view of the block shown in FIG. 4, taken along section line II—II of FIG. 1.
Figure 6:
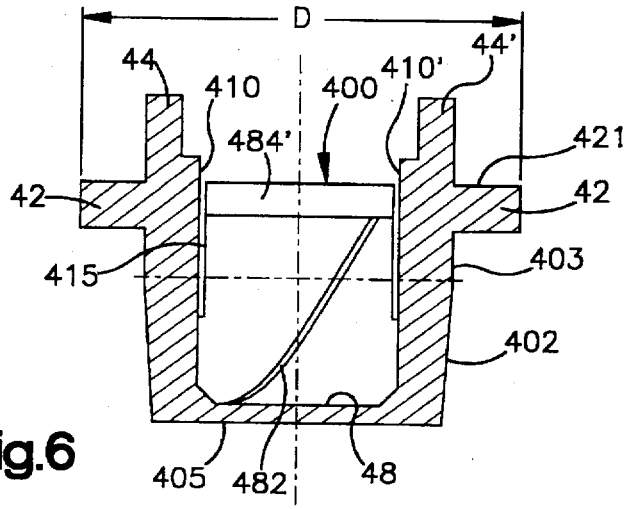
FIG. 6 is a further cross-section view of the block shown in FIG. 4, taken along section line III—III of FIG. 1.

A molded plastic block 40 is housed inside the piston 20, the block being so designed and arranged as to receive and hold a hardened steel roller 60 in order to provide a rolling friction coupling between the engine cam (not shown) and the tappet, so as to provide the thrust which is necessary to open the engine valve controlled by the associated hydraulic tappet. Referring particularly to FIGS. 4 to 6, the block 40 comprises the following elements:

(a) a circular top flange 42 having two upwardly directed fins 44, 44' extending therefrom which straddle the cam in order to hold the axis of the roller 60 aligned with that of the camshaft of the engine, the outer diameter D of said flange being adjusted to the inner diameter of the piston 20 so as to allow it to be mounted inside the latter;

(b) a diametral portion 400 comprising two opposite shoulders 46, 46' which bear on the annular shoulder 25 of the piston, the region under the shoulders being formed as a frusto-conical shaped bottom portion 402 downwardly converging and ending with a flat base 405 parallel to the top surface 421 of the flange 42. Owing to the intrinsic resilience of the plastic material forming said block 40, it is possible to assure a simultaneous bearing of the shoulders 46, 46' and the bottom 405 respectively on the shoulder 25 of the piston 20 and on the surface 242 of the inner bottom thereof (see FIG. 2). In FIG. 6, which is perpendicular to the view of FIG. 5, at the region included between the flange 42 and starting of the frustoconical portion 402, the block 40 is provided with a cylindrical region 403, having a diameter less than that of the inner wall of the bottom portion 24 of the piston 20;

(c) a cylindrical seat 48 formed in the central part of the portion 400 of the block 40, having a diameter suitable to receive the roller 60 so as to surround the latter more than half of the circumferential periphery thereof in order to positively retain the roller, said seat 48 being provided wit helical slots 482 in order to facilitate lubrication of the roller, and ending at the top thereof with two opposite beveled portions 484, 484' in order to permit the roller 60 to be snapped in from the top, instead of laterally inserting it. The portion 400 of the block 40 is provided, at the top portion thereof, with a reduced width so as to provide to slots 415, 415' which are symmetrical with respect to said flange 42 and define a lubricating oil passage to lubricate the roller 60. These slots downwardly extend substantially to the starting level of the frusto-concial shaped portion 402 of the block 40 in order to provide an oil flow path to the low pressure reservoir, as will be disclosed hereinafter.

The roller 60, which is provided with a weight-reducting inner hole 62, has a length equal to the distance between the walls 410, 410' of the block 40 defined by said slots 415, 415' so as to be held transversely secured in said block whereas, at the two end portions thereof, it is provided with beveled portions 64, 64' (see FIGS. 1 and 3) which facilitate the entry of oil to the seat 48 of the block.

With reference to FIGS. 1, 2 and 3, which illustrate the hydraulic tappet mounted in its operating condition, a low pressure reservoir 200 is formed between the piston 20 and block 40 and has, generally, an annular configuration (FIG. 2); whereas, at the opposite regions, that is those regions which are not in front of the portion 400 of the block, as shown in FIG. 3, the volume of the reservoir 200 is greater because of the volume taken up by the shoulders 46, 46'. Between the piston 20 and body 10 of the tappet, a chamber 15 is formed which constitutes the high pressure chamber.

The flow of lubricating oil between the low pressure reservoir and the high pressure chamber occurs through a series of holes 27 at the base of the piston 20, which are controlled by a check valve 28 in the form of a thin disk which covers the holes as the piston 20 is lowered under the thrust provided by the lobe of the cam of the camshaft against the roller 60 and transmitted via the block 40. When the piston 20 is again upwardly displaced inside said body 10 biased by the spring 30, a negative pressure will be created within chamber 15, allowing the valve 28 to be opened and oil to pass from the low pressure reservoir 200 to the high pressure chamber 15 for filling the latter.

The tappet according to the present invention will compensate for valve train lash in the same manner as a conventional hydraulic tappet, while being simply formed by few and simple structural elements. In addition, it provides the advantage of less stringent machining tolerances, thereby allowing a less power loss because of the rolling friction occurring between the cam and tappet.

I claim:

1. A direct-acting hydraulic tappet for an internal combustion engine, comprising a tappet body formed by a cylindrical element open at the top thereof and closed at the bottom thereof by a base; a cup-shaped piston slidingly received within said body; a spring seated on the base of said body and bearing against said piston to bias said piston upwardly; a plastic block received in said piston, a diametral portion of said block having a cylindrical seat formed therein; and a cam contacting roller received within said cylindrical seat; characterized in that said plastic block is provided at its top with a circular flange having a diameter congruent with the diameter of the inner wall of said piston and two upwardly directed fins extending from said flange in straddling relation to said roller.

2. A hydraulic tappet according to claim 1, characterized by a controlled clearance being defined between the contacting surfaces of said body and said piston to provide leakdown of said tappet.

3. A hydraulic tappet according to claim 2, characterized in that said block is provided with a frusto-conical shaped bottom portion downwardly converging and defining a low pressure reservoir between said piston and said block.

4. A hydraulic tappet according to claim 3, characterized in that said diametral portion of said block is, at the top portion thereof, laterally separated from said flange of said block so as to form two symmetrical slots to facilitate the inlet of the oil for the lubrication of said roller.

5. A hydraulic tappet according to claim 4, characterized in that at least one helical lubrication slot is formed on the surface of said seat.

6. A hydraulic tappet according to any one of claims 3 to 5, characterized by a high pressure chamber formed between the inner wall of said tappet body and the bottom portion of said piston and in that the transfer of oil between said low pressure reservoir is carried out through a plurality of ports arranged on the bottom of said piston, said ports being controlled by a check valve allowing oil to flow only from said reservoir to said high pressure chamber.

7. A hydraulic tappet according to claim 6, characterized by said check valve being in the form of a disk which is operable to cover said ports when said high pressure chamber is pressurized.

* * * * *